US008149176B2

(12) United States Patent
Hellberg

(10) Patent No.: US 8,149,176 B2
(45) Date of Patent: Apr. 3, 2012

(54) DEVICE AND METHOD FOR CONTROLLING A SATELLITE TRACKING ANTENNA

(75) Inventor: Daniel Hellberg, Järfälla (SE)

(73) Assignee: Saab AB, Linköping (SE)

( * ) Notice: Subject to any disclaimer, the term of this patent is extended or adjusted under 35 U.S.C. 154(b) by 169 days.

(21) Appl. No.: 12/597,650

(22) PCT Filed: Apr. 24, 2008

(86) PCT No.: PCT/EP2008/055021

§ 371 (c)(1),
(2), (4) Date: Apr. 12, 2010

(87) PCT Pub. No.: WO2008/132141

PCT Pub. Date: Nov. 6, 2008

(65) Prior Publication Data

US 2010/0201589 A1 Aug. 12, 2010

(30) Foreign Application Priority Data

Apr. 25, 2007 (EP) ..... 07106911

(51) Int. Cl.
*H01Q 3/00* (2006.01)

(52) U.S. Cl. ..... 343/766; 343/763

(58) Field of Classification Search ..... 343/760, 343/757, 758, 763, 764, 765, 766
See application file for complete search history.

(56) References Cited

U.S. PATENT DOCUMENTS 4,786,912 A 11/1988 Brown et al.

(Continued)

FOREIGN PATENT DOCUMENTS

EP 0338379 A 10/1989

(Continued)

OTHER PUBLICATIONS

PCT/IPEA/416—Notification of Transmittal of the International Preliminary Report on Patentability—Oct. 8, 2009.

(Continued)

*Primary Examiner* — Hoanganh Le
(74) *Attorney, Agent, or Firm* — Venable LLP; Eric J. Franklin

(57) ABSTRACT

A device for controlling a satellite tracking antenna. An azimuth drive is configured to impart an azimuthal rotational motion to the antenna about an azimuth axis. An elevation axis drive is configured to impart a rotational motion to the antenna about an elevation axis orthogonal to the azimuth axis. A tilt axis drive is configured to impart a rotational motion to the antenna about a tilt axis. The tilt axis is connected to the elevation axis in such a way that the rotational freedom of motion of the antenna about the tilt axis is dependent on the elevation angle such that: at an elevation angle of 0° the rotational freedom of motion of the antenna about the tilt axis corresponds to the azimuthal rotational motion; at an increasing elevation angle the rotational freedom of motion about the antenna successively transcends into a roll rotation; and at an elevation angle of 90° the rotational freedom of motion of the antenna about the tilt axis corresponds to a roll rotation about a roll axis orthogonal to the azimuth axis and to the elevation axis. A control controls the operation of the azimuth axis drive, the elevation axis drive, and the tilt axis drive. The control includes a true north seeking gyro for tracking position, orientation, direction and speed of movement of the device. The control further includes an additional gyro comprising an elevation gyro axis arranged to sense the elevation movement and a tilt gyro axis arranged to sense the tilt movement, so as to minimize the angular velocity of the antenna pointing vector. A method for controlling a satellite tracking antenna, and a vessel including the device.

10 Claims, 8 Drawing Sheets

U.S. PATENT DOCUMENTS

| | | | | |
|---|---|---|---|---|
| 6,285,338 | B1 | 9/2001 | Bai et al. | |
| 6,577,281 | B2 * | 6/2003 | Yamamoto et al. | 343/766 |
| 7,095,376 | B1 | 8/2006 | Timothy et al. | |
| 7,595,762 | B2 * | 9/2009 | Mansour | 343/757 |
| 2008/0297427 | A1 * | 12/2008 | Jung et al. | 343/766 |
| 2010/0265149 | A1 * | 10/2010 | Omori et al. | 343/766 |

FOREIGN PATENT DOCUMENTS

| | | | |
|---|---|---|---|
| GB | 2253520 | B1 | 9/1992 |
| WO | WO-2005/053093 | A | 6/2005 |
| WO | WO-2007/067016 | A | 6/2007 |
| WO | WO-2008/030041 | A | 3/2008 |

OTHER PUBLICATIONS

PCT/IPEA/409—International Preliminary Report on Patentability—Oct. 8, 2009.
PCT/ISA/210—International Search Report—Oct. 16, 2008.
PCT/ISA/237—Written Opinion of the Internatinal Searching Authority—Oct. 16, 2008.
PCT/IPEA/401—Demand—Feb. 25, 2009.
PCT/IB/304—Notification Concerning Submissionor Transmittal of Priority Document—Jun. 26, 2008.

* cited by examiner

DEVICE AND METHOD FOR CONTROLLING A SATELLITE TRACKING ANTENNA

CROSS-REFERENCE TO RELATED APPLICATIONS

This application claims priority to European patent application 07016911.6 filed 25 Apr. 2007and is the national phase under 35 U.S.C §371 of PCT/EP2008/055021 filed 25 Apr 2008.

TECHNICAL FIELD

The present invention relates to a device for controlling a satellite tracking antenna. The present invention further relates to a method and a vehicle.

BACKGROUND

In order to automatically track the position of a satellite, satellite receivers are installed in moving objects such as vehicles, ships or the like. A device comprises means for adjusting azimuth angle and elevation angle of the antenna such that the position of the satellite is automatically tracked without adjustment of the wave-receiving angle of the antenna.

The use of such a two-axis system on a moving vehicle requires, in order to maintaining contact with the satellite, that the direction vector all the time is kept parallel. To accomplish this with such a two-axis system roll movements are compensated by means of an azimuth motor which imparts a rotational motion to the antenna about an azimuth axis and an elevation motor which imparts a rotational motion to the antenna about an elevation axis. Such systems are well known.

However, at an elevation angle above 45° the response between roll motion and required compensation in azimuth and elevation direction becomes too large. At an elevation angle of 45° the response is 1:1, i.e. a roll motion of x°/s needs compensation in azimuth direction of x°/s. At an elevation angle larger than 45° the response increases and at an elevation angle of 90° the response is infinite. At an elevation angle of 90° there is thus a singularity. This above mentioned problem is referred to as the zenith problem.

In order to take the polarization in to consideration such systems further comprises means for adjusting the polarization angle of the transceiver head of the antenna, by means of imparting a rotational motion to the transceiver head about a polarization axis. This improves the possibilities of communicating with a satellite such that it is possible to both receive and transmit signals, also during movement, during conditions not involving the above mentioned zenith problem. However, at elevation angles above 45° involving roll motions such a three axis system does not work due to the above mentioned limitation in response. The requirements for transmitting/broadcasting are strict and during movement in these conditions such a system does not meet these requirements, as there will be noise transmitted to adjacent channels due to the limitation in tracking the antenna. Thus, the vehicle would have to stand still. However, in e.g. a war zone it may be desired to be able to transmit during movement when tracking a satellite at an elevation angle above 45°, in rough terrain involving roll motions. Also in other applications such as television broadcasting, fire fighting and the like the possibility of transmitting during movement in such conditions may be requested.

U.S. Pat. No. 7,095,376 discloses a device for controlling a satellite tracking antenna having a three-axis system, an azimuth axis, an elevation axis and in addition a tilt axis, said device being arranged on an aeroplane. The tilt axis is connected to the elevation axis in such a way that the rotational freedom of motion of the antenna about the tilt axis is dependent on the elevation angle such that it corresponds to an azimuthal rotational motion at an elevation angle of 0° and a roll rotation at an elevation angle of 90°, thus solving the Zenith problem. The change in roll, pitch and heading of the aircraft can be determined by an inertial navigation system.

OBJECTS OF THE INVENTION

An object of the present invention is to provide a device for controlling a satellite tracking antenna which is operable, at all elevation angles and during movement involving roll motion, to receive and transmit information.

Another object of the present invention is to provide a method for controlling a satellite tracking antenna which is operable, at all elevation angles and during movement involving roll motion, to receive and transmit information.

SUMMARY OF THE INVENTION

These and other objects, apparent from the following description, are achieved by a device and method for controlling a satellite tracking antenna, and a vehicle with said device.

Particularly an object is achieved by a device for controlling a satellite tracking antenna comprising an azimuth drive means configured to impart an azimuthal rotational motion to the antenna about an azimuth axis, an elevation axis drive means configured to impart a rotational motion to the antenna about an elevation axis orthogonal to the azimuth axis and a tilt axis drive means configured to impart a rotational motion to the antenna about a tilt axis, the tilt axis being connected to the elevation axis in such a way that the rotational freedom of motion of the antenna about the tilt axis is dependent on the elevation angle such that: at an elevation angle of 0° the rotational freedom of motion of the antenna about the tilt axis corresponds to the azimuthal rotational motion; at an increasing elevation angle the rotational freedom of motion about the antenna successively transcends into a roll rotation; and at an elevation angle of 90° the rotational freedom of motion of the antenna about the tilt axis corresponds to a roll rotation about a roll axis orthogonal to said azimuth axis and to said elevation axis, control means being provided for controlling the operation of the azimuth axis drive means, the elevation axis drive means, and the tilt axis drive means, said control means comprising means, preferably including a true north seeking gyro, for tracking position, orientation, direction and speed of movement of the device, wherein said control means further comprises an additional gyro comprising an elevation gyro axis arranged to sense the elevation movement and a tilt gyro axis arranged to sense the tilt movement, so as to minimize the angular velocity of the antenna pointing vector.

This improves the ability to both transmit and receive information. The additional gyro according to the invention improves the stabilising performance of the device. By having an additional gyro according to the invention it is easier to design servo control loops with higher bandwidth, and a higher bandwidth reduces disturbances with a broader frequency spectra. The additional gyro according to the invention improves the ability to make sure that the angular velocity of the antenna pointing vector is small in the inertial frame, thus improving ability to maintain a correct pointing direction in the global coordinate system defined by north, west and up, even in the case where the navigation system is not physically mounted on the device. Thus a navigation system, e.g. an inertial navigation system, located at a distance from the device, e.g. an existing navigation system located at the bridge of a ship, may be used. Such an additional gyro may provide a higher updating rate, i.e. the updating rate with which the gyro provides sensor data, i.e. the time it takes for the sensor data to be processed, in comparison to a true north seeking gyro as the north seeking gyro needs to continuously find true north. The additional gyro is thus arranged to control quick changes on the pointing direction of the antenna. Another advantage is that measured errors due to mechanical misalignment are minimized. This further facilitates using an inertial navigation system having only a two axis rate gyro when using a vessel on land, i.e. a land vehicle, or at sea, i.e. a ship or boat, and even in when using an aeroplane such as a passenger plane, i.e. a plane not doing manoeuvres such as looping, when assuming the roll and pitch angles to all the time be less than 45°, which is a field in which a two axis gyro of an INS usually offers reliable accuracy. A navigation system with a two axis gyro is cheaper than a navigation system with a three axis gyro, and hence costs may be reduced. This further facilitates using a small gyro which may be arranged at the tilt axis of the device without affecting movement due to load. Further a cheap additional gyro may be used as the additional gyro does not require high accuracy.

According to an embodiment of the device, said elevation gyro axis and said tilt gyro axis is arranged in a close proximity to the tilt axis. This has the advantage that the additional gyro more efficiently senses the motions of the axis, which increases the possibilities of designing an efficient servo that better damps disturbances that affects the antenna pointing vector, thus improving the ability to receive and transmit information. As the additional gyro is close to the tilt axis it may be configured small, i.e. having small dimensions.

According to an embodiment the device further comprises a polarization axis drive means configured to impart a rotational motion to a transceiver head of the antenna about a polarization axis orthogonal to the tilt axis, wherein the polarisation axis is connected to the tilt axis, control means being provided for controlling the polarization axis drive means. This further improves ability to both receive and transmit information. An advantage is that less bandwidth is required from the satellite transponder. Only one direction of polarisation, vertical or horizontal, needs to be used for communication. Other operators may use the second polarisation channel without being disturbed by the polarisation channel used by the device.

According to an embodiment of the device, said additional gyro further comprises a polarisation gyro axis arranged to sense the polarisation movement. This further improves ability to both receive and transmit information. This improves the ability to comply with the demands regarding the limitations of cross talk between the polarisation channels, i.e. reduces the risk of exceeding the cross talk limit.

According to an embodiment of the device, the elevation gyro axis, tilt gyro axis and polarisation gyro axis are provided as a unit orthogonally arranged relative to each other. This has the advantage that the gyro provides precise and reliable results due to the fact the angles are truly orthogonal and are not affected by other misalignments as might be the case would each gyro axis be separated from each other.

According to an embodiment of the device, said additional gyro has a bandwidth in the range of 60-150 Hz. This means that the additional gyro reacts quicker to sudden movements of the antenna pointing vector relative to a gyro of the navigation system.

According to an embodiment of the device, said additional gyro has an updating rate of gyro data in the range of 0.25-2 kHz. This means that the additional gyro provides quicker updates of change of movements of the antenna pointing vector such that angular velocity of the antenna pointing vector may be reduced to a minimum.

According to an embodiment of the device, said control means comprises an inertial navigation system A4. An inertial navigation system comprises the features such as computer, accelerometer, gyro etc. necessary for providing the required accuracy, integrated in a unit.

According to an embodiment of the device, said control means comprises absolute angular sensors arranged to sense the angle of rotation of the azimuth axis, elevation axis, tilt axis and polarisation axis, respectively. The angles provides data for calculating the pointing vector of the antenna in the horizontal system of the earth, i.e. north, up west.

According to an embodiment the device further comprises means for compensating for drift of the additional gyro by calculating the pointing error of the antenna pointing vector based upon data of the desired antenna pointing vector, the navigation system and the angle of rotation of the elevation axis, tilt axis and polarisation axis. This reduces/eliminates the drift of the gyro such that the desired pointing direction of the antenna pointing vector may be maintained for a long period of time.

An object is also achieved by a method for controlling a satellite tracking antenna comprising the steps of: imparting an azimuthal rotational motion to the antenna about an azimuth axis; imparting a rotational motion to the antenna about an elevation axis orthogonal to the azimuth axis; imparting a rotational motion to the antenna about a tilt axis, the tilt axis being connected to the elevation axis in such a way that the rotational freedom of motion of the antenna about the tilt axis is dependent on the elevation angle such that: at an elevation angle of 0° rotational freedom of motion of the antenna about the tilt axis corresponds to the azimuthal rotational motion; at an increasing elevation angle the rotational freedom of motion about the antenna successively transcends into a roll rotation; and at an elevation angle of 90° the rotational freedom of motion of the antenna about the tilt axis corresponds to a roll rotation; controlling the motion of the azimuth axis, the elevation axis, and the tilt axis such that the position, orientation, direction and speed of movement is tracked, comprising the further steps of sensing said elevation movement with an elevation gyro axis; and sensing the elevation movement with a tilt gyro axis so as to minimize the angular velocity of the antenna pointing vector.

This improves the ability to both transmit and receive information. The additional gyro according to the invention improves the stabilising performance of the device. The additional gyro according to the invention improves the ability to make sure that the angular velocity of the antenna pointing vector is small in the inertial frame, thus improving ability to maintain a correct pointing direction in the global coordinate system defined by north, west and up. The additional gyro is thus controls quick changes on the pointing direction of the antenna.

According to an embodiment the method further comprises the step of imparting a rotational motion to a transceiver head of the antenna about a polarization axis orthogonal to the tilt axis, wherein the polarisation axis is connected to the tilt axis. This further improves ability to both receive and transmit information. An advantage is that less bandwidth is required from the satellite transponder. Only one direction of polarisation, vertical or horizontal, needs to be used for communication. Other operators may use the second polarisation channel without being disturbed by the polarisation channel used by the device.

According to an embodiment of the method further comprises the step of sensing said polarisation movement with a polarisation gyro axis. This further improves ability to both receive and transmit information. This improves the ability to comply with the demands regarding the limitations of cross talk between the polarisation channels, i.e. reduces the risk of exceeding the cross talk limit.

DESCRIPTION OF THE DRAWINGS

A better understanding of the present invention will be had upon the reference to the following detailed description when read in conjunction with the accompanying drawings, wherein like reference characters refer to like parts throughout the several views, and in which.

DETAILED DESCRIPTION OF THE INVENTION

Figure 1:
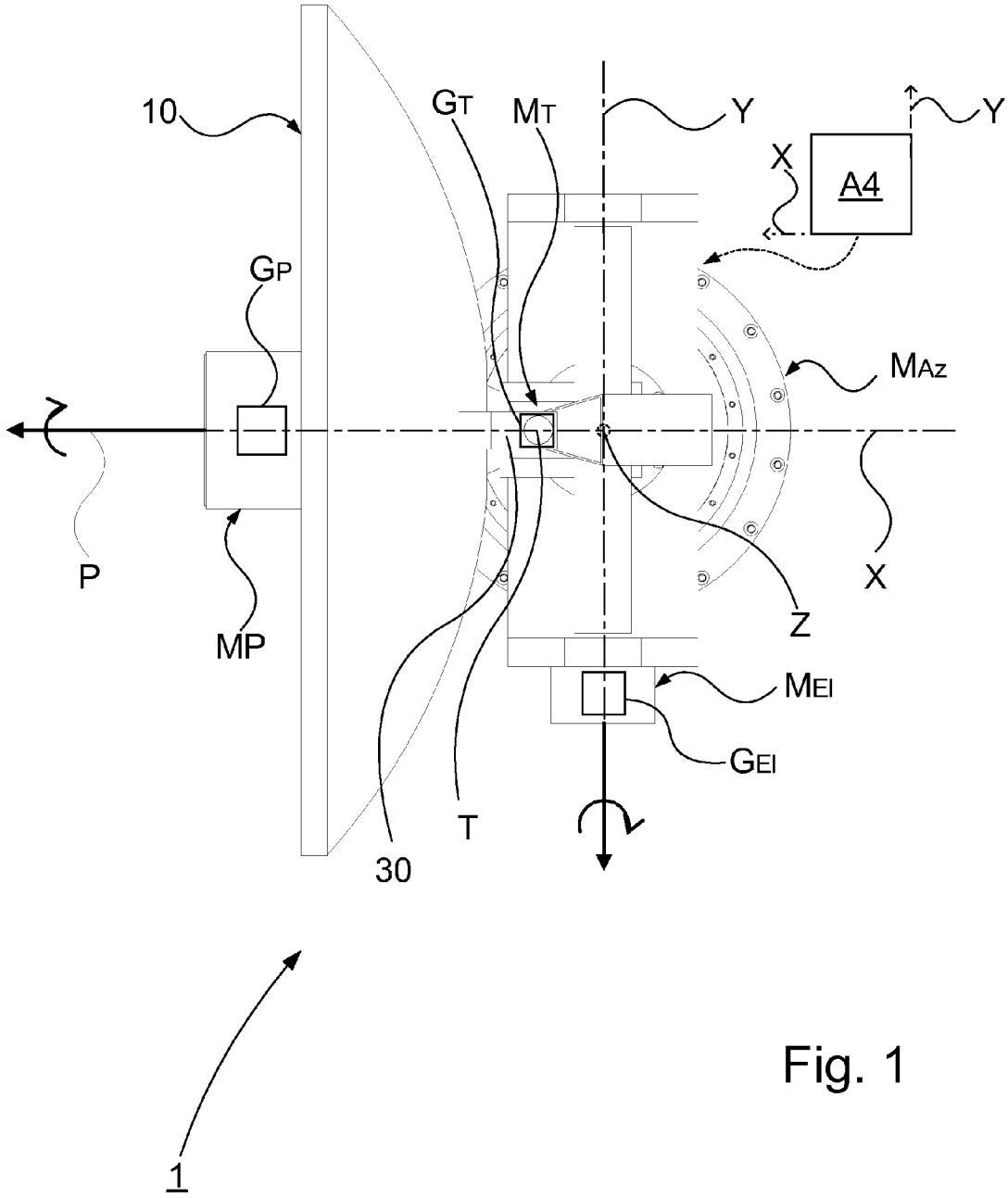
FIG. 1 schematically shows a plan view of a device according to a first embodiment of the present invention.

FIG. 1-5 show embodiments 1; 2; 3 of the device according to the present invention. Generally, as can be seen from FIG. 1-5, the device comprises an azimuth drive means $M_{Az}$ configured to impart an azimuthal rotational motion to an antenna 10 about an azimuth axis Z, an elevation axis drive means $M_{El}$ configured to impart a rotational motion to the antenna about an elevation axis Y, orthogonal to the azimuth axis Z, a tilt axis drive means $M_T$; $M_{T1}$, $M_{T2}$ configured to impart a rotational motion to the antenna about a tilt axis T, and a polarization axis drive means $M_p$ configured to impart a rotational motion to a transceiver head 11 of the antenna about a polarization axis P, orthogonal to the tilt axis T. The antenna 10 comprises a parabola and, thus, a transceiver head 11, i.e. the antenna 10 is configured to both transmit and receive signals/information. Preferably the transceiver head is rotatable about the polarization axis relative to the parabola, i.e. the parabola does not need to rotate as the transceiver head rotates.

The tilt axis T is connected to the elevation axis Y in such a way that the rotational freedom of motion of the antenna 10 about the tilt axis T is dependent on the elevation angle such that, at an elevation angle of 0° the rotational freedom of motion of the antenna about the tilt axis T corresponds to the azimuthal rotational motion, and at an increasing elevation angle the rotational freedom of motion of the antenna about the tilt axis T successively transcend into a roll rotation, and at an elevation angle of 90° the rotational freedom of motion of the antenna about the tilt axis T is a roll rotation, i.e. corresponds to the roll rotation of the antenna about a roll axis X. Thus, at an en elevation angle of 0° the tilt axis T is parallel to the azimuth axis Z, and at an elevation angle of 90° the tilt axis T is parallel to the roll axis X. The roll axis X is orthogonal to the azimuth axis Z, and to the elevation axis Y.

By means of the tilt axis of the device an excessively determined system is achieved which solves the so called zenith problem, in that compensation is achieved by means of rotating the antenna about the tilt axis. The stabilizing performance is increased. This further facilitates providing a satellite tracking antenna which, during movement apart from receiving information also is able to transmit information, when compensation of polarization is taken into consideration, even at elevation angles above 45°. The introduction of the tilt axis further reduces the need to moving the rest of the system, thus reducing mass moment of inertia. This thus facilitates providing an improved control system to the device. Further, drive means of less effect is thus required facilitating providing a more compact design. Thus a lighter device is further achieved.

The polarisation axis P is connected to the tilt axis T in such a way that the rotational freedom of motion of the transceiver head 11 of the antenna 10 about the polarization axis P is dependant on the elevation angle and the tilt angle such that, when the tilt angle is 0°, at an elevation angle of 0° the rotational freedom of motion of the transceiver head 11 about the polarization axis corresponds to a roll rotation about the roll axis X, and at an increasing elevation angle the rotational freedom of motion of the transceiver head 11 about the polarization axis transcend into, and at an elevation angle of 90° corresponds to a rotation about an azimuth axis Z. Thus, when the tilt angle is 0°, at an en elevation angle of 0° the polarization axis is parallel to the roll axis X, and at an elevation angle of 90° the polarization axis P is parallel to the azimuth axis Z. At, as an extreme, a tilt angle of 90° the polarization axis P is parallel to the elevation axis Y. The polarization axis P is thus orthogonal to the tilt axis T. The polarization axis is during operation all the time intended to point in the direction of the satellite.

The device 1; 2; 3 further comprises means for controlling operation of the azimuth axis drive means $M_{Az}$, the elevation axis drive means $M_{El}$, the polarization axis drive means $M_P$ and the tilt axis drive means $M_T$; $M_{T1}$, $M_{T2}$. The control means comprises a navigation system A4, schematically shown in FIG. 1, arranged to provide bearing, pitch and roll to the device relative to the horizontal plane of the earth, i.e. relative to inertial frame, north, west, up. Preferably the navigation system is a heading reference gyro. The navigation system needs to be aligned with the pointing direction of the transceiver head. The navigation system is preferably arranged proximate to the drive means, which simplifies mechanical alignment, but it may also be arranged at a distance from the drive means as will be explained below. According to one embodiment the navigation system A4 is an inertial navigation system (INS) A4. The inertial navigation system utilises a computer and motion sensors to continuously track the position, orientation, direction and speed of movement of the device, the device being arranged on e.g. a moving vehicle. The inertial navigation system comprises a computer and a module comprising accelerometers, and a true north seeking gyro.

Figure 2:
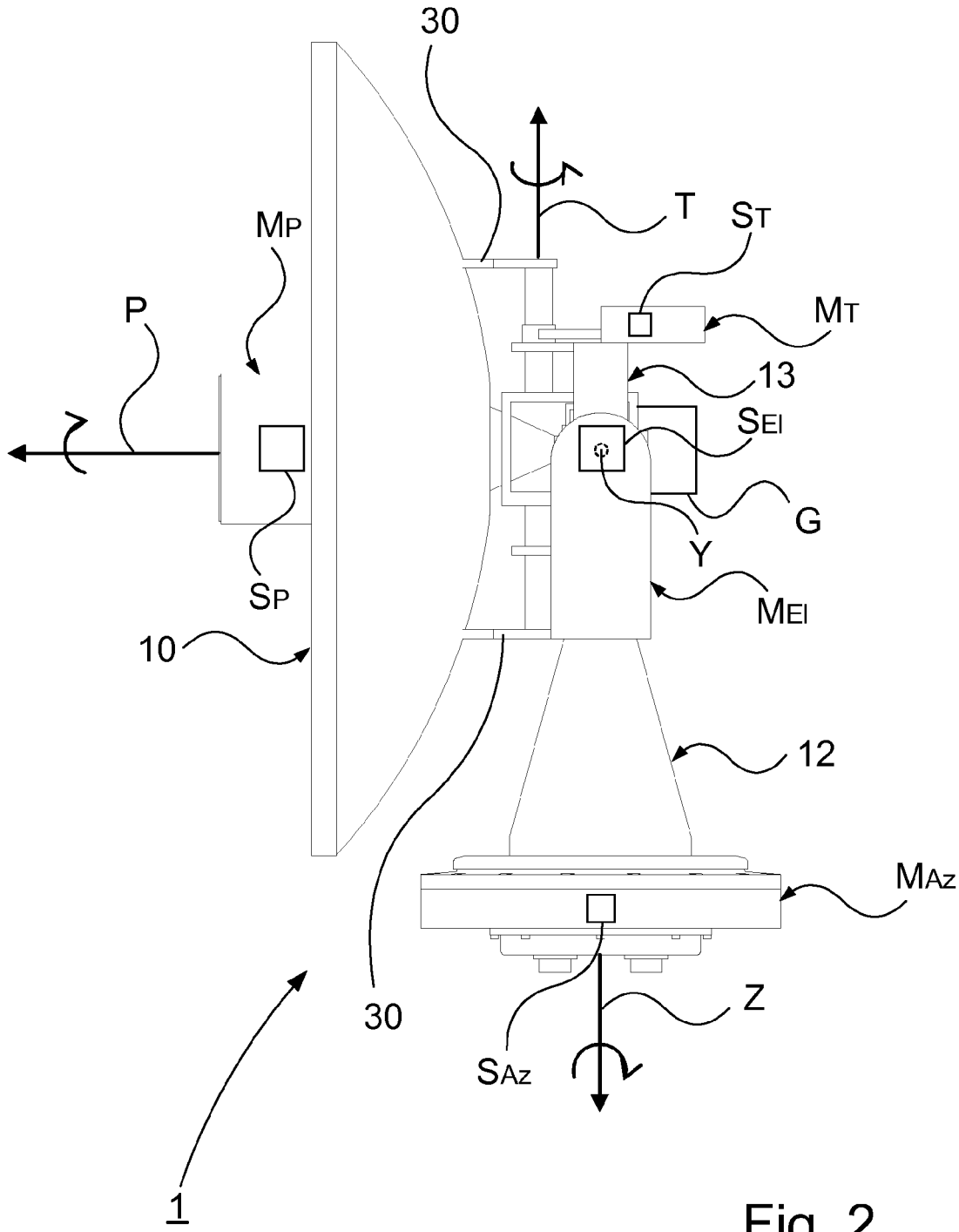
FIG. 2 schematically shows a side view of the device in FIG. 1.

The control means further comprises absolute angle sensors $S_{Az}$, $S_{El}$, $S_T$, $S_P$, schematically shown in FIG. 2, arranged to sense angles of rotation and transform the vector of direction in order to give the spatial tracking direction. The angle sensors are preferably encoders or resolvers. The location of the angle sensors may vary depending on design. The angles provided from the angle sensors are used to calculate the pointing direction of the antenna in the horizontal system of the earth, i.e. north, up, west, etc., i.e. an inertial frame, by means of the angles of the navigation system A4 and coordinate transformations. More specifically the control means comprises an azimuth angle sensor $S_{Az}$ arranged to sense the angle of rotation about the azimuth axis Z, an elevation angle sensor $S_{El}$ arranged to sense the angle of rotation about the elevation axis Y, a tilt angle sensor $S_T$ arranged to sense the angle of rotation about the tilt axis T, and a polarization angle sensor $S_p$ arranged to sense the angle of rotation about the polarization axis P.

Preferably the control means comprises an additional gyro which in one embodiment comprises three gyro axes $G_{El}$, $G_T$ and $G_P$, an elevation gyro axis $G_{El}$ arranged to be synchronized with the elevation movement, a tilt gyro axis $G_T$ arranged to be synchronized with the tilt movement, and a polarization gyro axis $G_P$ arranged to be synchronized with the polarization movement. The gyro axes are schematically shown in FIG. 1. The gyro axes improve the stabilizing performance of the device. As the azimuth rotation does not have to be precisely controlled an azimuth gyro axis is not required, but could be provided if desired.

Preferably the azimuth drive means is arranged at the "bottom" of the device, followed by the elevation drive means, the tilt drive means and the polarization drive means. Having the drive means arranged in this order, drive means of less effect, i.e. smaller motors, is required the higher up in the order, facilitating providing an improved control system to the device. Thus, the tilt and polarization drive means may be of small effect, i.e. small motors, for rotating the antenna, which preferably is made of light weight material.

When operated the device according to the present invention is intended to provide an azimuthal rotational motion of n×360°, an elevational rotational motion of −30° to 210°, a tilt rotational motion of −45° to 45° for application on land, and a tilt rotational motion of −60° to 60° for application on the sea, and a polarizational rotational motion of n×360°. However, if desired, other operational angles may be provided.

Figure 3:
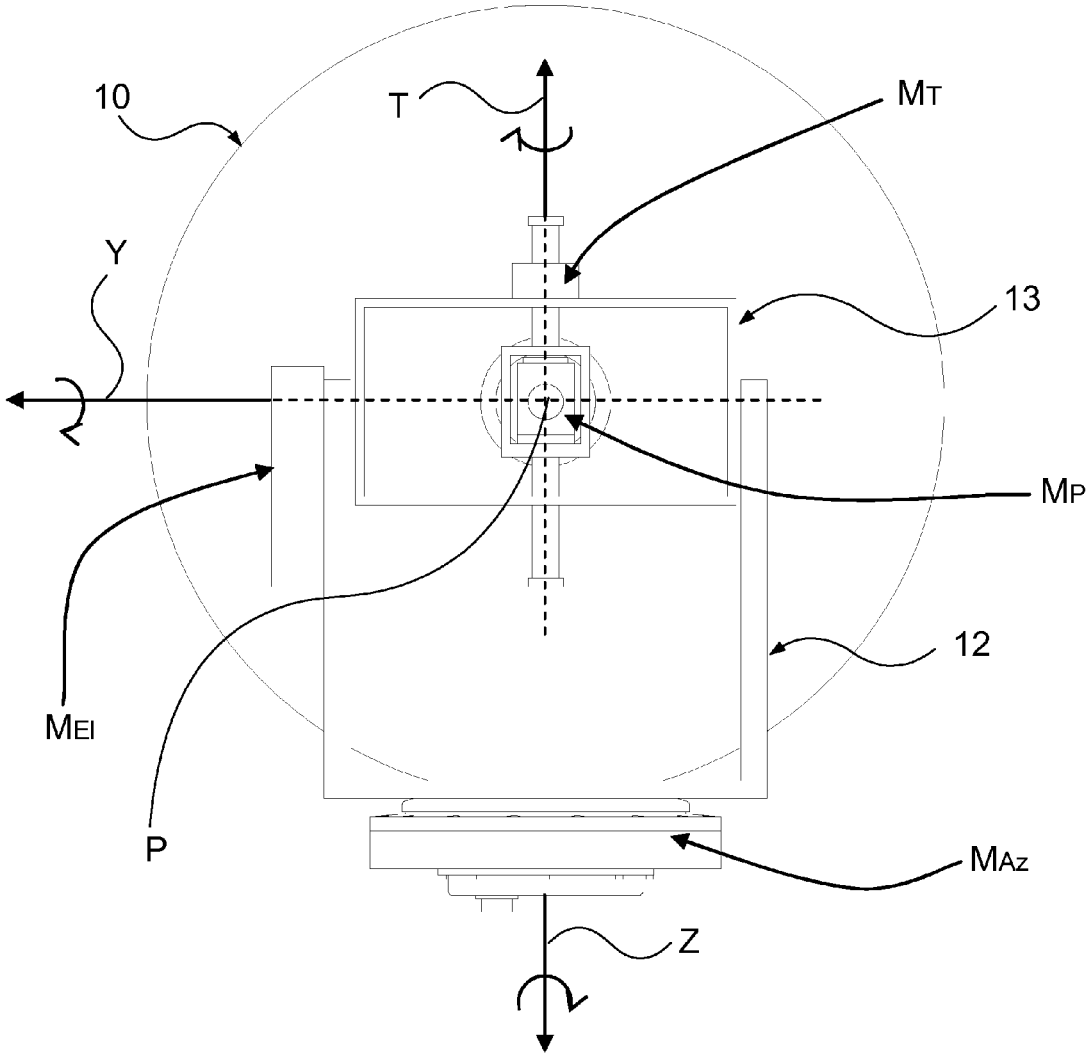
FIG. 3 schematically shows a back view of the device in FIG. 1.

FIG. 1-3 show different views of a device 1 for controlling a satellite tracking antenna 10 according to a first embodiment of the present invention. The azimuth axis drive means $M_{Az}$ constitutes a base. The base is arranged to support a support member 12 having a U-shaped configuration, said member being fixed to the base and having legs projecting upwardly from the base.

The support member 12 is arranged to carry a frame member 13 at an upper portion of said support member by means of the elevation axis Y, the frame member being rotatably arranged about the elevation axis Y. The elevation axis Y is thus located at a certain level above the base. The frame member 12 is connected to the antenna 10 via the tilt axis T. The tilt axis T is connected to the antenna 10 via a first and a second connection member 30, said members 30 being fixed to the antenna and connected to the tilt axis T such that the antenna is rotated when the tilt axis is rotated. The azimuth axis drive means $M_{Az}$ is arranged to impart a rotational motion to the base, and thus the support member 12, about the azimuth axis Z. The device 1 further comprises an extension 14 rotatably connected to the elevation axis Y and fixed to the antenna 10. The elevation axis drive means comprises an elevation motor $M_{El}$ arranged to impart a rotational motion to the frame member, and thus the antenna 10, about the elevation axis Y, the motor being connected to the elevation axis Y at a side of the support member.

In this embodiment the tilt axis drive means comprises a tilt motor $M_T$ arranged centrally relative to the azimuth axis and in the area of the tilt axis T. The tilt motor is arranged to impart a rotational motion to the antenna by means of rotating the tilt axis. A transmission means is arranged to impart the rotational motion of the tilt axis T, said transmission means here being a belt, but could alternatively e.g. be a gear configuration. The drive means are supplied by power means not shown.

Figure 4:
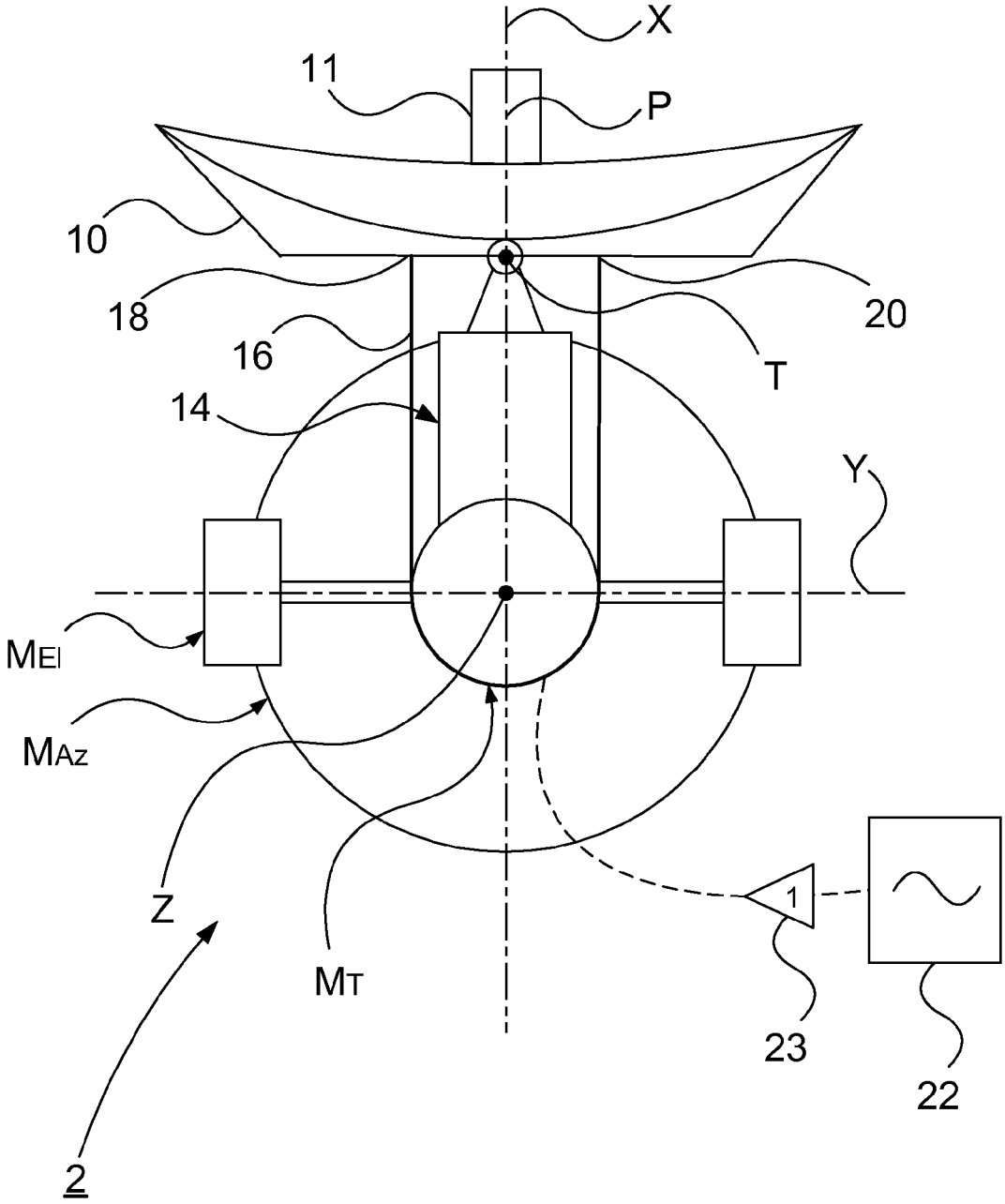
FIG. 4 schematically shows a plan view of a device according to a second embodiment of the present invention.

FIG. 4 shows schematically a plan view of a device 2 for controlling a satellite tracking antenna 10 according to a second embodiment of the present invention. The azimuth axis drive means $M_{Az}$ constitutes a base. The azimuth axis drive means $M_{Az}$ is arranged to impart a rotational motion to the base about the azimuth axis Z. The device further comprises an extension 14 rotationally connected to the elevation axis Y. The tilt axis T is connected to the elevation axis Y by means of said extension 14. The elevation axis drive means comprises a first and a second elevation motor $M_{El}$ arranged to impart a rotational motion to the extension 14, and thus the antenna 10, about the elevation axis Y, the first and second motor being connected to the elevation axis Y at each side of the elevation axis, respectively. Alternatively the elevation axis drive means comprises a single motor arranged to impart a rotational motion to the elevation arm 14 about the elevation axis, the motor being connected to a side of the elevation axis.

In this embodiment the tilt axis drive means comprises a tilt motor $M_T$ arranged to drive a transmission means constituted by a belt 16, said belt having a first and a second end, said first end being fixed to the antenna at a first connection point 18 and said second end being fixed to the antenna at a second connection point 20. The connection points are located at a first and a second side of the tilt axis T such that when the tilt motor m1 is driven the antenna is tilted about the tilt axis T by means of the belt 16. The tilt motor $M_T$ is arranged on the elevation arm 14. The tilt motor m1 is centrally arranged such that at an elevation angle of 0° it is arrange to rotate the belt 16 about the azimuth axis Z, and at an elevation angle of 90° it is arranged to rotate the belt about the roll axis X. The tilt motor is supplied by a power supply 22.

Figure 5:
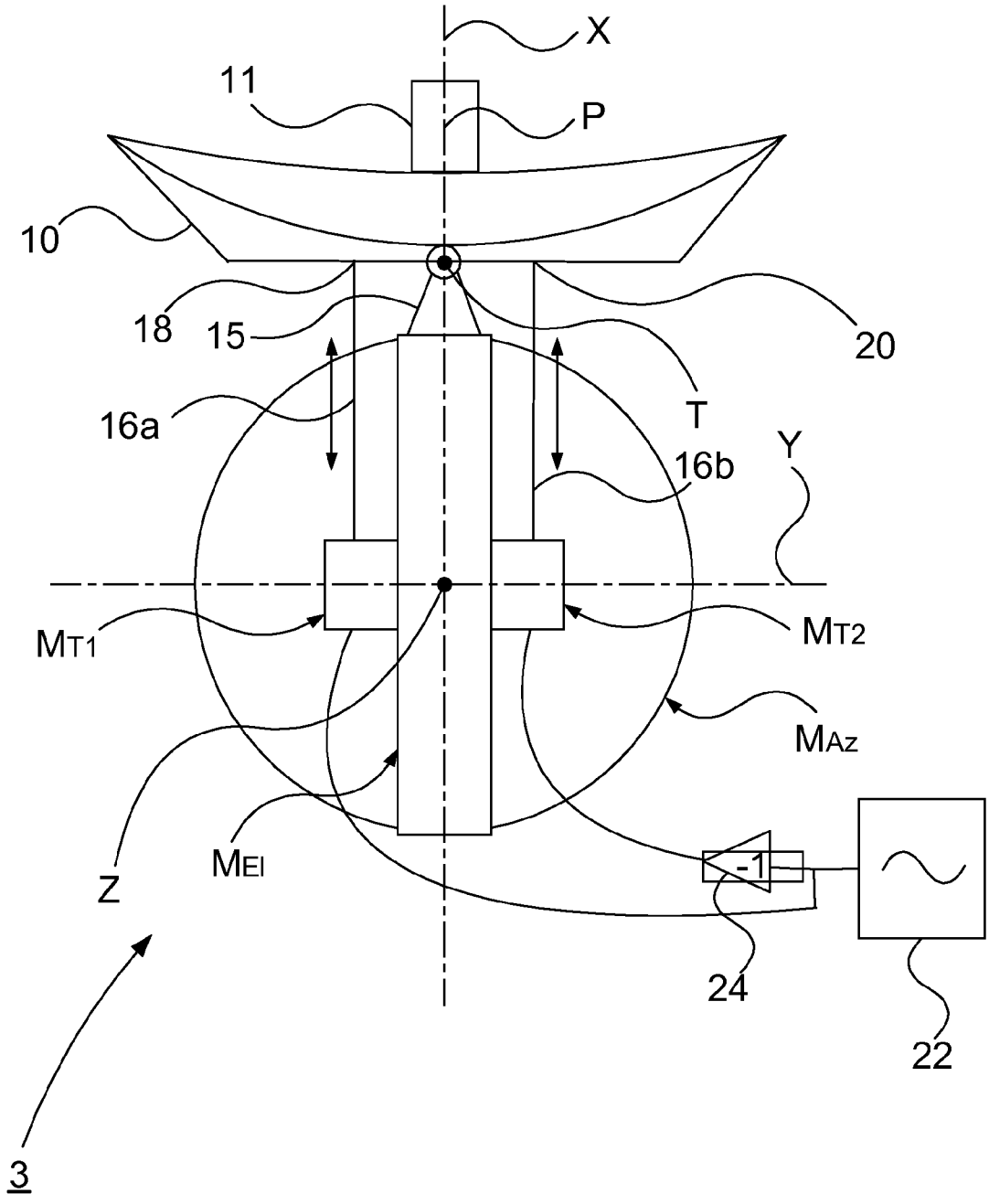
FIG. 5 schematically shows a plan view of a device according to a third embodiment of the present invention.

FIG. 5 shows schematically a plan view of a device 3 according to a third embodiment of the present invention. The azimuth axis drive means $M_{Az}$ constitutes a base, and is arranged to impart a rotational motion to the base about the azimuth axis. The elevation axis drive means $M_{El}$ is arranged to impart a rotational motion about the elevation axis Y. The device further comprises an extension 15 connected to the elevation axis drive means $M_{El}$. The tilt axis T is connected to the elevation axis Y by means of said extension 15. The tilt axis T is directly associated with the antenna 10, such that the antenna is rotatable about the tilt axis T. The elevation axis drive means comprises an elevation motor $M_{El}$ arranged to impart a rotational motion about the elevation axis Y, and thus to the antenna 10 via the extension 15.

In this embodiment the tilt axis drive means comprises a first and second tilt motor $M_{T1}$, $M_{T2}$. The first motor $M_{T1}$ is arranged to drive a transmission means constituted by a first belt **16*a* being fixed to the antenna 10 at a first connection point 18 and the second motor $M_{T2}$ is arranged to drive a second belt 16*b* being fixed to the antenna at a second connection point 20. The connection points are located at a first and a second side of the tilt axis T such that when the motors are driven the antenna 10 is tilted about the tilt axis T by means of the belts 16*a*, 16*b*. The tilt motors $M_{T1}$, $M_{T2}$ are arranged on each side of the elevation motor $M_{El}$, respectively. The motors are powered by a common power supply 22 such that the first motor operates in inverse to the second motor, by means of inverting one of the motors with inversion means 24**, i.e. when one motor is arranged to pull the belt the other motor is arranged to release the belt to the same extent.

In FIGS. 4 and 5 the navigation system, the angle sensors and the gyro axes are not shown.

In the second and third embodiments in FIGS. 4 and 5, the tilt axis T is directly associated to the antenna 10 such that, at an elevation angle of 0°, the tilt axis constitutes the vertical axis of the antenna, and, at an elevation angle of 90°, the tilt axis constitutes the horizontal axis or x-axis of the antenna. Thus the antenna 10 when rotated about the tilt axis is rotated about its own axis.

As an alternative to the second and third embodiment of FIGS. 4 and 5 the tilt axis drive means may comprise a tilt motor arranged to drive an endless belt, said belt being arranged about the tilt axis. The tilt axis may be connected to the antenna via a connection member, said member being fixed to the antenna such that when operated, the tilt motor imparts a rotational motion to the tilt axis, and thus the antenna via the connection member, by means of the belt. The tilt axis is connected to the antenna via a connection member, said member being fixed to the antenna.

As an alternative to the connection member the endless belt may be used having the tilt axis located in accordance with the first embodiment, directly associated with the antenna, said belt being arranged about a tilt axis. The antenna is then intended to be fixed to the tilt axis. When operated, the tilt motor imparts a rotational motion to the tilt axis, and thus the antenna, by means of the belt.

As an alternative to the two belts in FIG. 4, one belt may be used, said belt being arranged about the tilt axis. The antenna is intended to be fixed to the tilt axis. When operated, the tilt motor imparts a rotational motion to the tilt axis member, and thus the antenna, by means of the belt.

Alternatively the connection member may be applied to the second and third embodiments such that the connection member is fixed to the antenna, and the belt is fixed at a first and second connection point to the connection member. The connection points are located at a first and a second side of the tilt axis such that when the motors are driven the connection member is rotated about the tilt axis, and thus the antenna is rotated about the tilt axis by means of the belt/belts.

Any type of drive means facilitating imparting a rotational motion to the antenna about the tilt axis may be used. For example, a gear type drive means, or drive means of linear motor type may alternatively be used.

Figure 6:
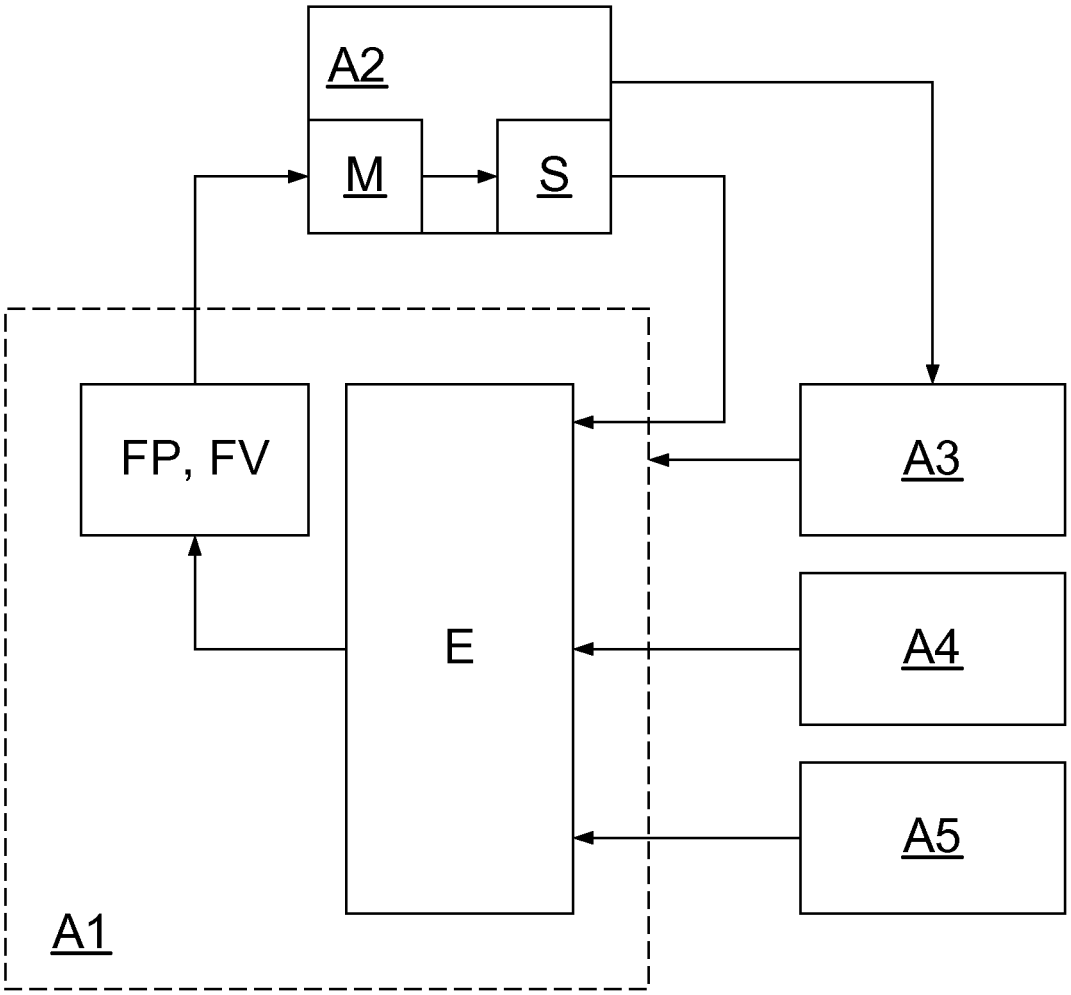
FIG. 6 schematically shows a diagram of a system for controlling a satellite tracking antenna.

FIG. 6 schematically shows a diagram of a system for controlling a satellite tracking antenna according to the present invention. Generally the system comprises means for controlling the drive means of the device so as to control the axis of the device.

The system comprises a central processing unit or microcomputer A1, comprising an error calculator for calculating the pointing error of the respective axis, i.e. azimuth axis, elevation axis, tilt axis and where applicable the polarisation axis. The microcomputer A1 comprises software arranged to realize servo loops that calculates control signal for the drive means, i.e. $M_{Az}$, $M_{El}$, $M_T$ and where applicable M.

The microcomputer A1 comprises a pointing error calculator E arranged to calculate the pointing error of the of the azimuth axis, elevation axis, tilt axis and where applicable the polarisation axis by means of coordinate transformations.

The microcomputer A1 further comprises a controller FP, FV for controlling the position FP and velocity FV of the azimuth axis, elevation axis, tilt axis and where applicable the polarisation axis.

The control system also comprises angular velocity determination means A2 comprising the drive means, i.e. $M_{Az}$, $M_{El}$, $M_T$ and where applicable $M_P$ and absolute angle sensors $S_{Az}$, $S_{El}$, $S_T$, and where applicable $S_P$, said means A2 being arranged to provide angles of rotation based upon input of torque command to the drive means.

The control system also comprises an additional gyro according to the present invention comprising an elevation gyro axis $G_{El}$ arranged to sense the elevation movement and a tilt gyro axis $G_T$ arranged to sense the tilt movement and where applicable a polarisation gyro axis $G_P$ arranged to be sense the polarisation movement of the device. The angular velocity of the elevation axis and the tilt axis will be sensed by the corresponding gyro.

The control system also comprises north finding gyro A4. According to an embodiment the control system comprises an inertial navigation system (INS) A4, arranged to continuously provide bearing, pitch and roll, i.e. the change in bearing, pitch and roll.

The system comprises a pointing direction means A5 called pointing solution. The Pointing Solution gives the direction where to point, defining the angles, bearing, pitch and where applicable polarization. The pointing solution is the calculated pointing direction to the satellite. The pointing direction is calculated by means of the location of the device on the earth, and by means of data of the position of the satellite around the earth, i.e. the orbit of the satellite around the earth. The direction of the pointing vector PS is determined by bearing angle ψ and pitch angle θ. The location of the device on the earth may be determined by means of coordinates/tables or by means of GPS positioning.

The additional gyro A3 is arranged to feed information about movement of the axis to the microcomputer, i.e. to the velocity controller, in an inner loop so as to control the velocity of the drive means of the respective axis.

The error calculator calculates the pointing error of the respective axis, i.e. azimuth axis, elevation axis, tilt axis and where applicable the polarisation axis based on information about bearing, pitch and roll angle from the inertial navigation system A4 and the pointing solution A5, and by information of the absolute angle of each axis given by the absolute angle sensors $S_{Az}$, $S_{El}$, $S_T$ and $S_p$.

The calculated error of the respective axis is fed in an outer loop to the position controller.

Figure 7:
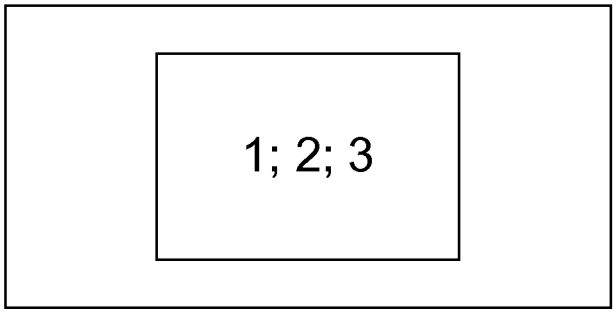
FIG. 7 schematically shows a vessel comprising the device according to the present invention.

FIG. 7 schematically shows a vessel comprising the device 1; 2; 3 according to the present invention. According to one embodiment the vessel is a vehicle intended for use on solid ground. According to another embodiment the vessel is a ship or boat intended for use at sea. According to yet another embodiment the vessel is an aeroplane intended for use in the air.

Figure 8:
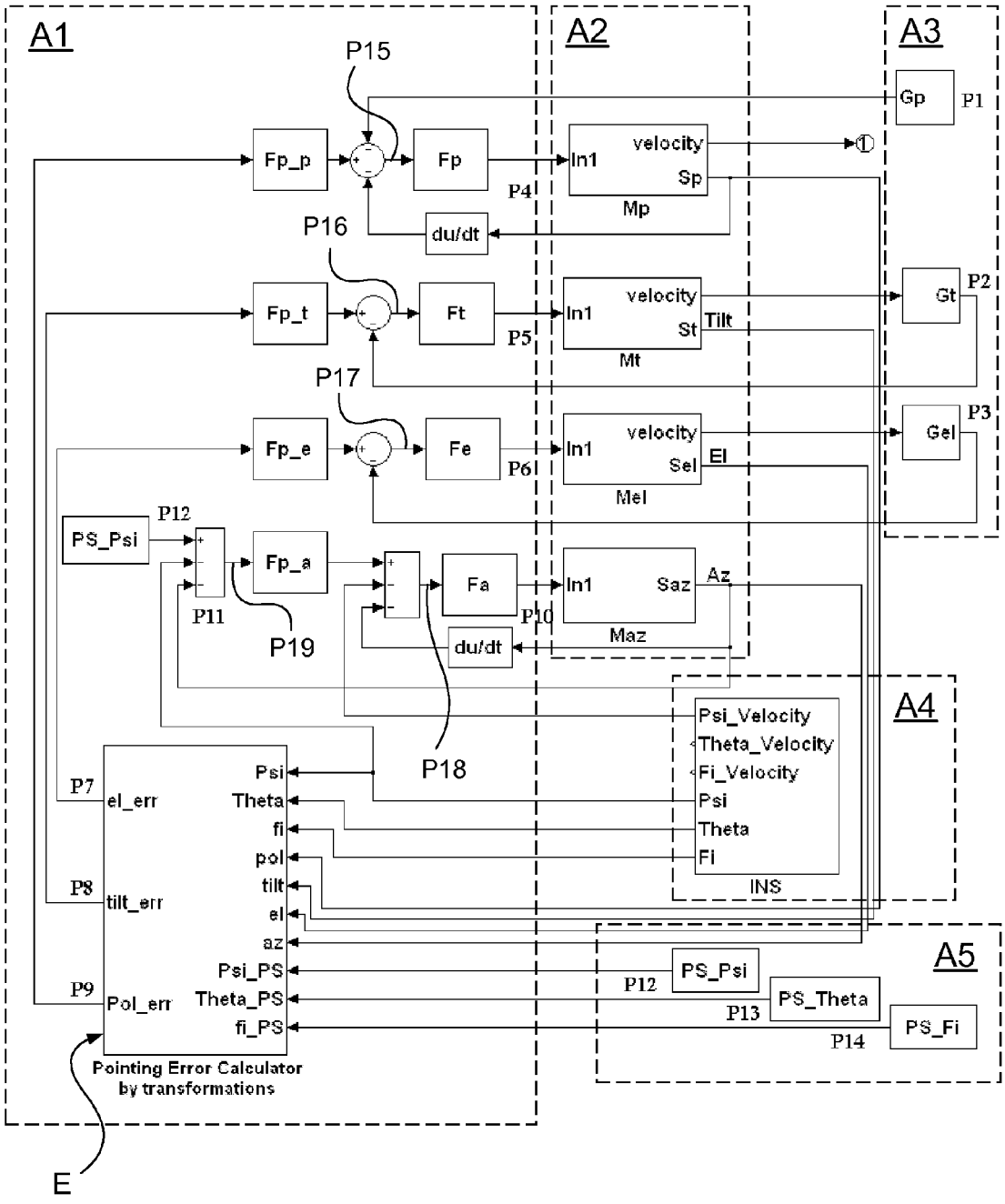
FIG. 8 schematically shows a diagram of a four axis system for controlling a satellite tracking antenna according to the present invention.

FIG. 8 schematically shows a diagram of a four axis system for controlling a satellite tracking antenna according to a preferred embodiment of the present invention. Generally the system comprises means for controlling the drive means of the device so as to control the axis of the device.

The system comprises a central processing unit or microcomputer A1, comprising an error calculator for calculating the pointing error of the respective axis, i.e. elevation axis, tilt axis and where applicable the polarisation axis. The microcomputer A1 comprises software arranged to realize servo loops that calculates control signal for the drive means, i.e. $M_{Az}$, $M_{El}$, $M_T$ and M.

The microcomputer A1 comprises a pointing error calculator arranged to calculate the pointing error of the of the elevation axis el_err, tilt axis tilt_err and the polarisation axis Pol_err.

The microcomputer A1 further comprises a control means for controlling the position and velocity of the azimuth axis, elevation axis, tilt axis and the polarisation axis. The control means comprises an azimuth position controller Fp_a, an elevation position controller Fp_e, a tilt position controller Fp_t and a polarisation position controller Fp_p. The control means further comprises an azimuth velocity controller Fa, an elevation velocity controller Fe, a tilt velocity controller Ft and a polarisation position controller Fp.

The control system also comprises angular velocity determination means A2 comprising the drive means, i.e. $M_{Az}$, $M_{El}$, $M_T$ and $M_p$ and absolute angle sensors $S_{Az}$, $S_{El}$, $S_T$, and $S_P$, said means A2 being arranged to provide angles of rotation based upon input of torque command to the drive means.

The control system also comprises an additional gyro A3 according to the present invention comprising an elevation gyro axis $G_{El}$ arranged to sense the elevation movement and a tilt gyro axis $G_T$ arranged to sense the tilt movement and where applicable a polarisation gyro axis $G_P$ arranged to sense the polarisation movement of the device. The angular velocity of the in the antenna pointing vector relative to the stars, i.e. the angular velocity of the elevation axis, tilt axis, and the polarisation axis, will be sensed by the corresponding axis of the additional gyro.

The control system also comprises an inertial navigation system (INS) A4, arranged to continuously provide bearing Psi, pitch Theta and roll Fi, i.e. the change in bearing, pitch and roll, and the corresponding angular velocities. The INS comprises a computer, accelerometers, a true north seeking gyro to continuously track the position, orientation, and direction and speed of movement of the device 10. Because of the fact that the INS is an inertial north seeking sensor e.g. from its sensors (accelerometers and gyro) extracts the direction to the earth north pole, which is fixed, the INS has a zero drift in mean in the inertial frame Up, North West.

The system comprises a pointing direction means A5 called pointing solution PS. The Pointing Solution gives the direction where to point, defining the angles, bearing, pitch and polarization. The pointing direction means comprises a bearing pointing solution angle PS_Psi, a pitch pointing solution angle PS_Theta and a polarisation pointing solution angle PS_Fi. The pointing solution is the calculated pointing direction to the satellite. The pointing direction is calculated by means of e.g. providing the location of the device on the earth, and by means of data of the position of the satellite around the earth, i.e. the orbit of the satellite around the earth. The direction of the pointing vector PS is determined by bearing angle PS_Psi and pitch angle PS_Theta.

The elevation gyro axis $G_{El}$ is arranged to feed back P3 information about movement of the elevation axis via the elevation velocity controller Fe, in an inner loop P6 so as to control the velocity of the elevation drive means of the elevation axis. The tilt gyro axis $G_T$ is arranged to feed back P2 information about movement of the tilt axis via the tilt velocity controller Ft, in an inner loop P5 so as to control the velocity of the tilt drive means of the tilt axis. The polarisation gyro axis $G_P$ is arranged to feed forward A1 information about movement of the polarisation axis to the polarisation velocity controller Fp, in an inner loop P4 so as to control the velocity of the polarisation drive means of the elevation axis.

The error calculator calculates the pointing error of the elevation axis el_err, the tilt axis tilt_err and the polarisation axis pol_err based on information about bearing, pitch and roll angle from the inertial navigation system A4 and the angles given by the angular sensors $S_{Az}$, $S_{El}$, $S_T$ and $S_P$. By means of coordinate transformations the pointing solution is then transformed into the coordinate system described by the antenna 10, and the pointing errors are extracted. The inertial navigation system A4 provides bearing angle Psi, Pitch angle Theta and roll angle fi to the error calculator. The bearing pointing solution provides the pointing solution bearing angle Psi_PS via P12 to the error calculator. The pitch pointing solution provides the pointing solution pitch angle Theta_PS via P13 to the error calculator. The polarisation pointing solution provides the pointing solution polarisation angle fi_PS via P12 to the error calculator. By means of transformations the pointing error of the elevation axis el_err, the tilt axis tilt_err and the polarisation axis pol_err are calculated based on the angles from A4 and A5.

The calculated error of the elevation axis el_err is fed in an outer loop P7 to the elevation position controller through which it is filtered. The calculated error of the tilt axis tilt_err is fed in an outer loop P8 to the tilt position controller through which it is filtered. The calculated error of the polarisation axis pol_err is fed in an outer loop P9 to the elevation position controller through which it is filtered. The desired error of the elevation axis el_err, the tilt axis tilt_err and the polarisation axis pol_err is naturally zero, respectively.

An azimuth drive means torque command is established by means of comparing the bearing pointing solution angle PS_Psi with the bearing Psi provided by the INS and the azimuth rotational angle Az determined by means of the azimuth angular sensor Saz, the comparison P19 then being filtered through the aziumth position controller Fp_a, the filtered data then being compared with the bearing angular velocity Psi_velocity and the azimuth angle velocity (du/dt, i.e. derivative of Az provided by $S_{Az}$), said comparison P18, which is desired to be zero in velocity, being filtered through the azimuth velocity controller Fa. Said filtered signal is then the torque command, which is then continuously provided to the aziumth drive means Maz so as to control the elevation axis An elevation drive means torque command is established by means of filtering the elevation pointing error el_err through the elevation position controller, comparing the filtered data with the elevation angle velocity data from the elevation gyro axis Gel and filtering said resulting comparison P15, which is desired to be zero in velocity, through the elevation velocity controller. Said elevation torque command is then continuously provided to the elevation drive means Mel so as to control the elevation axis.

A tilt drive means torque command is established by means of filtering the tilt pointing error tilt_err through the tilt position controller, comparing the filtered data with the tilt angle velocity data from the tilt gyro axis Gt and filtering said resulting comparison P16, which is desired to be zero in velocity, through the tilt velocity controller. Said tilt torque command is then continuously provided to the tilt drive means Mt so as to control the tilt axis.

A polarisation drive means torque command is established by means of filtering the polarisation pointing error pol_err through the polarisation position controller, comparing the filtered data with the additional gyro polarisation angular velocity data and the polarization axis angle velocity (du/dt, i.e. derivative of Pol provided by $S_P$), and filtering said resulting comparison P17, which is desired to be zero in velocity, through the polarisation velocity controller. Said polarisation torque command is then continuously provided to the elevation drive means Mp so as to control the polarisation axis.

The common purpose of all the control signals to the motors, i.e. to the drive means, is to keep the angular velocity of the antenna pointing vector as small as possible and maintain a correct pointing direction of the antenna in the frame Up, North West.

The axis of the four axis device is arranged to be controlled in the following order, azimuth Z, elevation Y, tilt T and polarization P, by means of the corresponding drive means. It is designed to be able to point in a certain direction in the global coordinate system defined by North, West and Up. The direction where to point is given by means of the Pointing Solution A5, defining three angles, bearing PS_Psi, Pitch PS_Theta and Polarization PS_fi as seen in FIG. 8. The pointing solution is the calculated pointing direction to the satellite. The pointing direction is calculated by means of the location of the device on the earth and by means of data of the position of the satellite around the earth, i.e. the orbit of the satellite around the earth. The direction of the pointing solution pointing vector is determined by bearing angle and pitch angle. The polarisation gives the channel with which information is to be received and/or transmitted. The angles called bearing, pitch and roll are also defined in the same manner by the North finding gyro, which according to the embodiment in FIG. 8 is an Inertial Navigation System (INS), which is used as an integrated part of the system for controlling a satellite tracking antenna.

The idea of using a four-axis system of the described configuration according to the present invention is to be able to virtually decouple one axis from the control system. This is achieved by letting the azimuth turntable, i.e. the azimuth drive means Maz, be controlled in such manner that the angle given by the azimuth angle sensor $S_{Az}$ on the azimuth turntable in the local frame, i.e. North, West, Up has the same angle as the bearing angle PS_Psi of the Pointing Solution subtracted by the bearing angle Psi of the INS.

By using absolute angle sensors on each axis and information of the orientation of the device, i.e. bearing, pitch and roll, which is provided by the navigation system, e.g. inertial navigation system, the Pointing Solution can be transformed to the local coordinate system described by the motions of Azimuth, Elevation and tilt. See FIGS. 9*a* and 9*b*. The main bearing is then roughly controlled by the azimuth turntable, i.e. azimuth drive means $M_{Az}$ as mentioned above. The fast correction of the platform pointing vector is then achieved by controlling elevation and tilt axis by using the additional three axis gyro G mounted on the elevation-tilt frame, see FIG. 2. The three axis gyro mounted on the Elevation-Tilt frame is used to make the feedback control loops, P4, P5 and P6 in FIG. 8, faster when controlling the elevation, tilt and polarization axis, due to the fact that the additional three-axis gyro has a higher bandwidth than the INS and a higher update frequency, as will be explained in more detail below. The outer loops, P7, P8 and P9 in FIG. 8, to maintain an accurate pointing vector, which means that the pointing vector for the device maintains the same as the pointing solution in the inertial frame, is as mentioned above, done by using absolute angle sensors, e.g. optical encoders or electrical resolvers, and the Navigation system, and then continuously make necessary coordinate transformations and calculate remaining angle errors for each axis, and then use these error signals as outer feedback signal P7, P8 and P9 in FIG. 8. This implies that the pointing vector of the device will have zero drift, because the Navigation System is a true north finding gyro with zero drift in mean.

An embodiment of the present invention with a four axis control system using said absolute angle sensor, three axis gyro and a north seeking gyro to be able to receive and transmit via a satellite link on the move is thus shown in FIG. 8.

The matrices used to define the rotations of the INS in the inertial frame (North, West, Up) are defined as follows for bearing Psi (ψ), Pitch Theta (θ) and roll Fi (ϕ).

The Matrices that defines the pointing solution, e.g. the pointing vector towards the satellite in the inertial frame, are defined with equal matrices, which are as follows $$M_\Psi = \begin{bmatrix} \cos\psi_2 & \sin\psi_2 & 0 \\ -\sin\psi_2 & \cos\psi_2 & 0 \\ 0 & 0 & 1 \end{bmatrix}$$

$$M_\theta = \begin{bmatrix} \cos\theta_2 & 0 & \sin\theta_2 \\ 0 & 1 & 0 \\ -\sin\theta_2 & 0 & \cos\theta_2 \end{bmatrix}$$

$$M_\varphi = \begin{bmatrix} 1 & 0 & 0 \\ 0 & \cos\varphi_2 & \sin\varphi_2 \\ 0 & -\sin\varphi_2 & \cos\varphi_2 \end{bmatrix}$$

The matrices defining the rotation of the device in the local frame (X, Y, Z) are defined as follows for bearing az (ψ), Pitch/elevation Theta (θ8), Tilt Beta (β) and polarization Fi (ϕ).

$$P_{az} = \begin{bmatrix} \cos\psi_N & \sin\psi_N & 0 \\ -\sin\psi_N & \cos\psi N & 0 \\ 0 & 0 & 1 \end{bmatrix}$$

$$P_{el} = \begin{bmatrix} \cos\theta_N & 0 & \sin\theta_N \\ 0 & 1 & 0 \\ -\sin\theta_N & 0 & \cos\theta_N \end{bmatrix}$$

$$P_{tilt} = \begin{bmatrix} \cos\beta_N & \sin\beta_N & 0 \\ -\sin\beta_N & \cos\beta_N & 0 \\ 0 & 0 & 1 \end{bmatrix}$$

$$P_{pol} = \begin{bmatrix} 1 & 0 & 0 \\ 0 & \cos\varphi_N & \sin\varphi_N \\ 0 & -\sin\varphi_N & \cos\varphi_N \end{bmatrix}$$

Figure 9A:
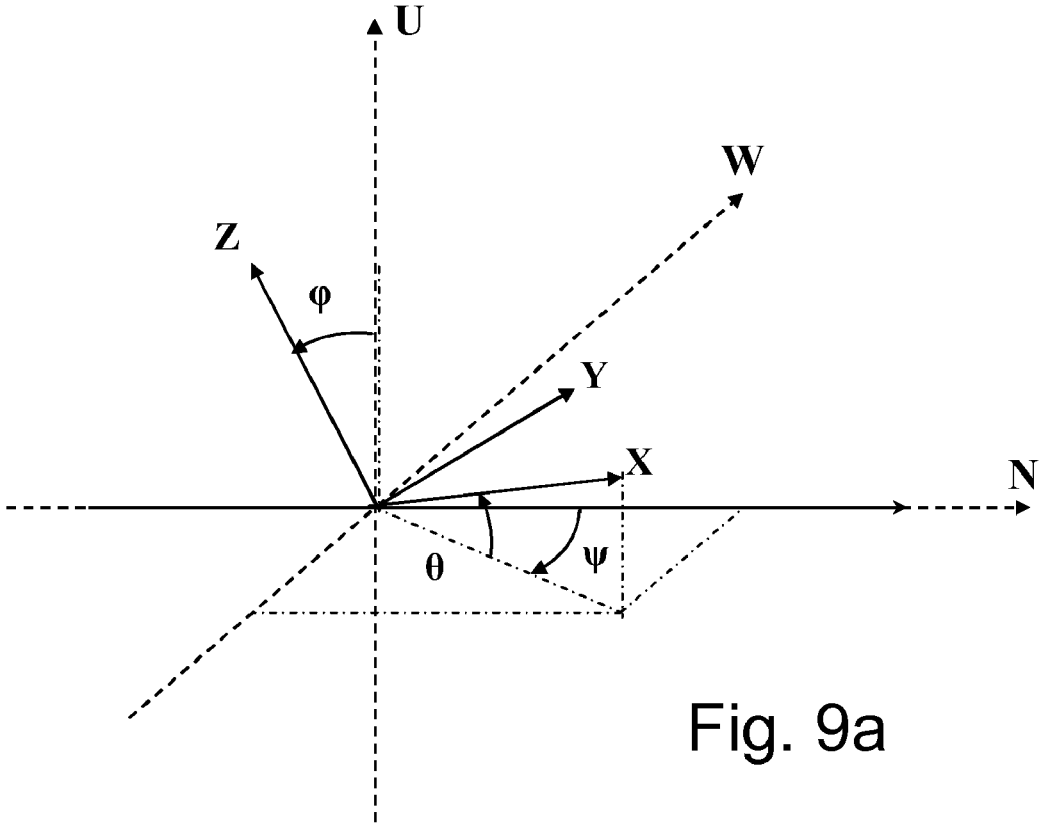
FIG. 9*a* schematically shows the coordinate system described by the navigations system.

FIG. 9*a* schematically shows the coordinate system described by the navigations system. The vector X represents the pointing direction of the INS x-axis. The INS x-axis gets its pointing direction by the movements of the device, e.g. movement of a vessel on which the device is arranged, in the inertial frame (Up, North, West). Thus the orientation of the coordinate system (X, Y, Z) relative to the coordinate system (Up, North, West) is measured by the navigation system, e.g. INS, and passed on to the control system, i.e. the microcomputer, see FIG. 8. The movements are mathematically described by the above described Matrices $M_\psi$, $M_\Theta$, and $M_\Phi$.

Figure 9B:
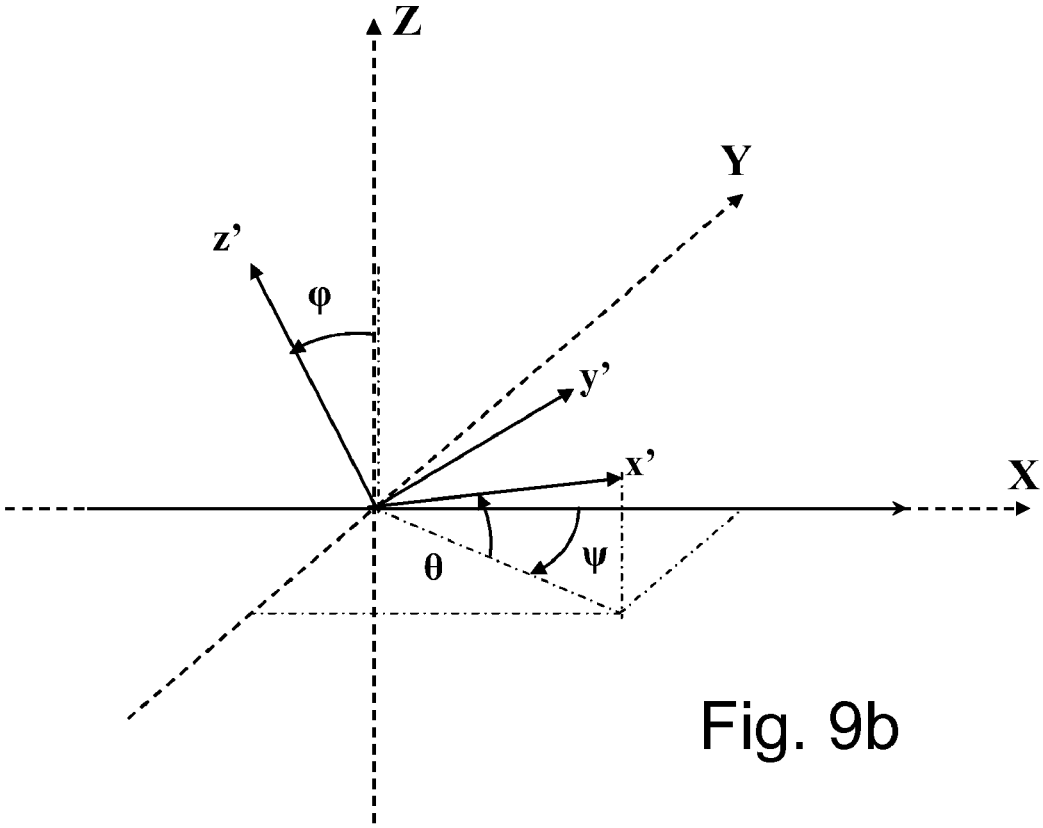
FIG. 9*b* schematically shows the coordinate system described by the device.

FIG. 9*b* schematically shows the coordinate system described by the device. The vector x' represents the pointing direction of the antenna. The antenna gets its pointing direction by the movements of the axis of the device, i.e. azimuth, elevation, tilt and polarization axis. The movements are performed by controlling the drive means, i.e. the motors, thus the orientation of the coordinate system (x', y' z') relative to the coordinate system (X, Y, Z) is decided by these movements. The movements are mathematically described by the above described Matrices $P_{Az}$, $P_{El}$, $P_{Tilt}$ and $P_{Pol}$ The advantage of using an additional three-axis gyro is that it improves the ability to make sure that the angular velocity of the antenna pointing vector is small in the inertial frame, i.e. relative to the stars, and thus improves the ability to maintain a correct pointing direction in the global coordinate system defined by North, West and Up even in the case where the Navigation System is not physically mounted directly on the four axis stabilized platform, i.e. the not directly mounted to the axis of the device.

By having the additional gyro G arranged to sense the movement of the axes of the device, e.g. in the two axis additional gyro case, an elevation gyro axis $G_{El}$ arranged to sense the elevation movement and a tilt gyro axis $G_T$ arranged to sense the tilt movement of the antenna, and in the tree axis case, in addition, a polarisation gyro axis GP arranged to sense the polarisation movement of the antenna, measured errors due to mechanical misalignment are minimized. Should the rate gyros of the inertial navigation system (INS) be used to calculate the angular velocity of the pointing vector of the antenna, theses calculations would contain error contributions due to mechanical and electrical misalignment between platform and the INS itself.

The advantage with the detection of the additional gyro with the movement of the axes is that it facilitates using an INS having only a two axis rate gyro when using a vessel on land, i.e. a land vehicle, or at sea, i.e. a ship or boat, and even in when using an aeroplane such as a passenger plane, i.e. a plane not doing manoeuvres such as looping. This because the roll and pitch angles are assumed to all the time be less than 45°, which is a field in which a two axis gyro of an INS usually offers reliable accuracy. This would thus not be possible, should the navigation system be mounted on the same location as the additional two or three axis gyro, i.e. on the tilt axis, the tilt axis in turn being connected to the elevation axis since the pitch angle would be too large, should the commanded pointing direction, i.e. the pointing solution, exceed 45°.

By mounting the navigation system on the tilt axis, i.e. elevation-tilt frame the navigation system would instantly shift bearing as the pitch angle of the navigation system exceeds 90°, since the pitch angle in a navigation system is defined in the range [−90°, 90°]. This is avoided by having an additional gyro according to the present invention, and thus construction of the control logic, i.e. the servo of the system is made easier.

Further, an advantage of the additional three axis gyro G for feedback of the quick changes of the pointing direction of the antenna 10 of the device 1; 2; 3, i.e. the angular velocity of the elevation, tilt and polarisation movement, is that the additional gyro is provided with higher bandwidth and a higher updating rate on the sensor data which it provides, in comparison to the navigation system, e.g. the INS. The additional gyro is thus arranged to control quick changes on the pointing direction of the antenna. The gyro is arranged to sense the changes of the antenna, i.e. movements of the elevation axis Y, tilt axis T and the polarisation axis P are arranged to be sensed by means of the elevation gyro axis $G_{El}$, the tilt gyro axis $G_T$ and the polarisation gyro axis $G_P$, respectively.

The higher bandwidth of the gyro is accomplished due to the fact that its raw data is not heavily low pass filtered/mean value built. The bandwidth of this type of gyro is typically in the range of 60-150 Hz. Preferably the bandwidth is about 100 Hz. The updating rate of gyro data is according to an embodiment in the range of 0.25-2 kHz, provided it is digital, and if it is analogue the updating rate is as quick as possible. Preferably the updating rate is >500 Hz. Hence the updating rate can be higher than 2 kHz, and a higher updating rate or frequency gives better performance of the additional gyro.

At the expense of the higher bandwidth of the additional gyro G, a lower accuracy of the additional gyro is achieved, due to higher drift, noisier signal and lower scale factor accuracy. High bandwidth and high updating rate of gyro data renders the gyro suitable for using in an inner loop for removing/damping transient disturbances, i.e. quick changes in the pointing direction of the antenna 10 due to high frequency disturbances affecting the system/device. From the navigation system data will be provided at a certain rate, e.g. 50 Hz, i.e. the data is 20 ms "old", whereas the additional gyro may have an updating rate of e.g. 1 kHz meaning that this data is only 1 ms "old".

However it is not suitable for maintaining an accurate pointing direction relative to North, Up, West, since the additional gyro suffers from drift, which would mean that the pointing direction of the antenna would drift away from the desired pointing direction, i.e. the pointing solution. The problem of drift of the additional gyro is solved by calculating the pointing error of the antenna by means of the bearing, pitch and roll data of the navigation system and by means of the angular sensors $S_{Az}$, $S_{El}$, $S_T$ and $S_p$, i.e. determining the difference between the pointing vector of the antenna and the desired pointing vector, i.e. pointing solution. More specifically the drift of the additional gyro G is compensated for by means of calculating the pointing error of the antenna pointing vector based upon data of the desired antenna pointing vector A5, bearing, pitch and roll data of the navigation system and data of the angle of rotation of the azimuth axis, elevation axis, tilt axis and polarisation axis provided by the respective angular sensors $S_{Az}$, $S_{El}$, $S_T$, $S_P$.

This is done by means of coordinate transformations as explained above. These pointing errors are used to close the outer loops of the control system according to FIG. 8.

In summary the additional gyro according to the present invention is arranged to control the quick, i.e. transient, high frequency disturbances by means of the feed back of the angular velocity data of the additional gyro to the drive means, i.e. the elevation drive means, the tilt drive means and the polarisation drive means. The navigation system is arranged to close the outer loops, i.e. position loops, to compensate for the drift of the additional gyro of the inner loops, or servo loops. Since the navigation system has zero drift in mean as it comprises a true north finding gyro it is assured that the desired pointing direction is maintained. Thus a device for controlling a satellite tracking antenna which is operable, at all elevation angles and during movement involving roll motion, to receive and transmit information is achieved.

The device is intended to be arranged on a vessel. Advantageously the device according to the present invention, including the feature of the polarisation drive means and the polarisation gyro axis, may be applied in e.g. a war zone where it is desired to be able to transmit during movement in rough terrain involving elevation angles above 45° and roll motions, and also in other applications such as television broadcasting, fire fighting and the like under above mentioned conditions, where the possibility of transmitting during movement is desired. This is due to the fact that the requirements for transmitting/broadcasting are fulfilled due to the improved response time, and thus there will be no noise transmitted to adjacent channels.

The foregoing description of the preferred embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated.

The invention claimed is:

1. A device for controlling a satellite tracking antenna comprising an azimuth drive configured to impart an azimuthal rotational motion to the antenna about an azimuth axis, an elevation axis drive configured to impart a rotational motion to the antenna about an elevation axis orthogonal to the azimuth axis, a tilt axis drive configured to impart a rotational motion to the antenna about a tilt axis, a polarization axis drive configured to impart a rotational motion to a transceiver head of the antenna about a polarization axis orthogonal to the tilt axis, wherein the polarisation axis is connected to the tilt axis, and wherein said tilt axis is connected to the elevation axis in such a way that a rotational freedom of motion of the antenna about the tilt axis is dependent on the elevation angle, such that:

at an elevation angle of 0° the rotational freedom of motion of the antenna about the tilt axis corresponds to the azimuthal rotational motion;

at an increasing elevation angle the rotational freedom of motion about the antenna successively transcends into a roll rotation; and at an elevation angle of 90° the rotational freedom of motion of the antenna about the tilt axis corresponds to a roll rotation about a roll axis orthogonal to said azimuth axis and to said elevation axis, a control configured to control operation of the azimuth axis drive, the elevation axis drive, the polarisation axis drive, and the tilt axis drive, said control comprising a true north seeking gyro, configured to track position, orientation, direction and speed of movement of the device, wherein said control further comprises absolute angular sensors arranged to sense the angle rotation of the azimuth axis, elevation axis, tilt axis and polarization axis, respectively, wherein said control further comprises an additional gyro comprising an elevation gyro axis arranged to sense the elevation movement and a tilt gyro axis arranged to sense the tilt movement, a compensator configured to compensate for drift of the additional gyro by calculating a pointing error of the antenna pointing vector based upon data of the desired antenna pointing vector, bearing, pitch and roll of the navigation system and the angle of rotation of the azimuth axis, elevation axis, tilt axis and polarisation axis, wherein said pointing error of the respective axis is arranged to be fed in an outer loop of a position controller, wherein said additional gyro further is arranged to feed information about movement of the axis to the velocity controller, in an inner loop so as to control the velocity of said drive of the respective axis, where the additional gyro is further arranged to control the high frequency disturbances by means of feed back of angular velocity data of the additional gyro to the drive, so as to minimize the angular velocity of the antenna pointing vector.

2. The device according to claim 1, wherein said elevation gyro axis and said tilt gyro axis is arranged at the tilt axis.

3. The device according to claim 2, wherein said additional gyro further comprises a polarisation gyro axis arranged to sense the polarization movement.

4. The device according to claim 3, wherein the elevation gyro axis, tilt gyro axis and polarisation gyro axis are provided as a unit orthogonally arranged relative to each other.

5. The device according to claim 1, wherein said additional gyro has a bandwidth in the range of 60-150 Hz.

6. The device according to claim 1, wherein said additional gyro has an updating rate of gyro data in the range of 0.25-2 kHz.

7. The device according to claim 1, wherein said control comprises an inertial navigation system.

8. A method for controlling a satellite tracking antenna, the method comprising:

imparting an azimuthal rotational motion to the antenna about an azimuth axis;

imparting a rotational motion to the antenna about an elevation axis orthogonal to the azimuth axis;

imparting a rotational motion to the antenna about a tilt axis;

imparting a rotational motion to a transceiver head of the antenna about a polarization axis orthogonal to the tilt axis, wherein the polarisation axis is connected to the tilt axis, said tilt axis being connected to the elevation axis in such a way that the rotational freedom of motion of the antenna about the tilt axis is dependent on the elevation angle such that:

at an elevation angle of 0° rotational freedom of motion of the antenna about the tilt axis corresponds to the azimuthal rotational motion;

at an increasing elevation angle the rotational freedom of motion about the antenna successively transcends into a roll rotation; and at an elevation angle of 90° the rotational freedom of motion of the antenna about the tilt axis corresponds to a roll rotation;

controlling the motion of the azimuth axis, the elevation axis, the polarization axis, and the tilt axis such that the position, orientation, direction and speed of movement is tracked, sensing the angle of rotation of the azimuth axis, elevation axis, tilt axis and polarisation axis with absolute angular sensors sensing said elevation movement with an elevation gyro axis;

sensing the elevation movement with a tilt gyro axis, feeding utilzing said additional gyro information about movement of the axis to the velocity controller, in an inner loop so as to control the velocity of a drive of the respective axis, compensating for the drift of the additional gyro by calculating the pointing error of the antenna pointing vector based upon data of the desired antenna pointing vector, feeding said pointing error of the respective axis in an outer loop, to control the velocity of said drive of the respective axis, and controlling utilizing said additional gyro the disturbances utilizing feedback of angular velocity data of the additional gyro to the drive, so as to minimize the angular velocity of the antenna pointing vector.

9. The method according to claim 8, further comprising:

sensing said polarisation movement with a polarisation gyro axis.

10. A vessel, comprising:

a device comprising an azimuth drive configured to impart an azimuthal rotational motion to the antenna about an azimuth axis, an elevation axis drive configured to impart a rotational motion to the antenna about an elevation axis orthogonal to the azimuth axis, a tilt axis drive configured to impart a rotational motion to the antenna about a tilt axis, a polarization axis drive configured to impart a rotational motion to a transceiver head of the antenna about a polarization axis orthogonal to the tilt axis, wherein the polarisation axis is connected to the tilt axis, and wherein said tilt axis is connected to the elevation axis in such a way that a rotational freedom of motion of the antenna about the tilt axis is dependent on the elevation angle, such that:

at an elevation angle of 0° the rotational freedom of motion of the antenna about the tilt axis corresponds to the azimuthal rotational motion;

at an increasing elevation angle the rotational freedom of motion about the antenna successively transcends into a roll rotation; and at an elevation angle of 90° the rotational freedom of motion of the antenna about the tilt axis corresponds to a roll rotation about a roll axis orthogonal to said azimuth axis and to said elevation axis, a control configured to control operation of the azimuth axis drive, the elevation axis drive, the polarisation axis drive, and the tilt axis drive, said control comprising a true north seeking gyro configured to track position, orientation, direction and speed of movement of the device, wherein said control further comprises absolute angular sensors arranged to sense the angle rotation of the azimuth axis, elevation axis, tilt axis and polarization axis, respectively, wherein said control further comprises an additional gyro comprising an elevation gyro axis arranged to sense the elevation movement and a tilt gyro axis arranged to sense the tilt movement, a compensator configured to compensate for drift of the additional gyro by calculating a pointing error of the antenna pointing vector based upon data of the desired antenna pointing vector, bearing, pitch and roll of the navigation system and the angle of rotation of the azimuth axis, elevation axis, tilt axis and polarisation axis, wherein said pointing error of the respective axis is arranged to be fed in an outer loop of a position controller, wherein said additional gyro further is arranged to feed information about movement of the axis to the velocity controller, in an inner loop so as to control the velocity of said drive of the respective axis, where the additional gyro is further arranged to control the high frequency disturbances by means of feed back of angular velocity data of the additional gyro to the drive, so as to minimize the angular velocity of the antenna pointing vector.

* * * * *